US010647132B2

(12) United States Patent
Goh et al.

(10) Patent No.: US 10,647,132 B2
(45) Date of Patent: May 12, 2020

(54) PARTIALLY DRIED INKJET MEDIA OUTPUT MANAGEMENT

(71) Applicant: Hewlett-Packard Development Company, L.P., Houston, TX (US)

(72) Inventors: Jun Hong Goh, Singapore (SG); Fei Nie, Shanghai (CN); Wee Hien Tok, Singapore (SG); Wei Lit Teoh, Singapore (SG)

(73) Assignee: Hewlett-Packard Development Company, L. P., Spring, TX (US)

( * ) Notice: Subject to any disclaimer, the term of this patent is extended or adjusted under 35 U.S.C. 154(b) by 0 days.

(21) Appl. No.: 16/085,939

(22) PCT Filed: Jun. 23, 2016

(86) PCT No.: PCT/US2016/038979
§ 371 (c)(1),
(2) Date: Sep. 17, 2018

(87) PCT Pub. No.: WO2017/222531
PCT Pub. Date: Dec. 28, 2017

(65) Prior Publication Data

US 2019/0092049 A1 Mar. 28, 2019

(51) Int. Cl.
*B41J 11/00* (2006.01)
*B41J 13/02* (2006.01)
(Continued)

(52) U.S. Cl.
CPC ..... *B41J 11/0015* (2013.01); *B41J 13/025* (2013.01); *B41J 13/106* (2013.01); *B65H 29/14* (2013.01); *B65H 29/52* (2013.01); *B65H 29/70* (2013.01); *B65H 31/02* (2013.01); *B65H 2301/4212* (2013.01); *B65H 2301/5122* (2013.01); *B65H 2301/51214* (2013.01); *B65H 2404/1115* (2013.01); *B65H 2404/1312* (2013.01); *B65H 2404/141* (2013.01);
(Continued)

(58) Field of Classification Search
CPC .. B41J 11/0015; B41J 11/0005; B41J 13/025; B41J 13/106; B41J 13/02
See application file for complete search history.

(56) References Cited

U.S. PATENT DOCUMENTS 5,153,663 A 10/1992 Bober et al.
5,738,454 A 4/1998 Zepeda et al.
(Continued)

FOREIGN PATENT DOCUMENTS

CN 1659036 8/2005
CN 1246661 3/2006
JP 2013226803 A * 11/2013 ..... B41J 2/04556

OTHER PUBLICATIONS

Herrnanna, D.K., Taguchi Optimization in the Design of a Printer Registration System, Jan. 22, 2007, < http://www.tandfonline.com/doi/abs/~2 pages.

*Primary Examiner* — Jason S Uhlenhake
(74) *Attorney, Agent, or Firm* — Brooks Cameron & Huebsch PLLC

(57) ABSTRACT

In one example, a device for partially dried inkjet media output management includes a starwheel positioned on a first side between a number of rollers positioned on a second side to corrugate partially dried inkjet media between the starwheel and the number of rollers.

14 Claims, 6 Drawing Sheets

(51) Int. Cl.

| | |
|---|---|
| ***B65H 29/14*** | (2006.01) |
| ***B65H 29/52*** | (2006.01) |
| ***B65H 29/70*** | (2006.01) |
| ***B65H 31/02*** | (2006.01) |
| ***B41J 13/10*** | (2006.01) |

(52) U.S. Cl.
CPC ..... *B65H 2404/1522* (2013.01); *B65H 2405/114* (2013.01); *B65H 2405/11151* (2013.01); *B65H 2511/10* (2013.01); *B65H 2511/20* (2013.01); *B65H 2511/224* (2013.01); *B65H 2801/15* (2013.01)

(56) References Cited

U.S. PATENT DOCUMENTS

| | | | | |
|---|---|---|---|---|
| 5,897,258 | A | 4/1999 | Wen et al. | |
| 5,947,467 | A | 9/1999 | Billings et al. | |
| 6,190,070 | B1 | 2/2001 | Urban et al. | |
| 9,031,492 | B2 | 5/2015 | Oohara et al. | |
| 2013/0257938 | A1* | 10/2013 | Arakane ..... | B41J 25/3082 347/8 |
| 2014/0204142 | A1 | 7/2014 | Akakane | |
| 2015/0029263 | A1 | 1/2015 | Akakane | |
| 2015/0328903 | A1* | 11/2015 | Chanclon Fern ndez ..... | B41J 11/006 271/3.18 |

* cited by examiner

PARTIALLY DRIED INKJET MEDIA OUTPUT MANAGEMENT

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make processes difficult.

DETAILED DESCRIPTION

Figure 1A:
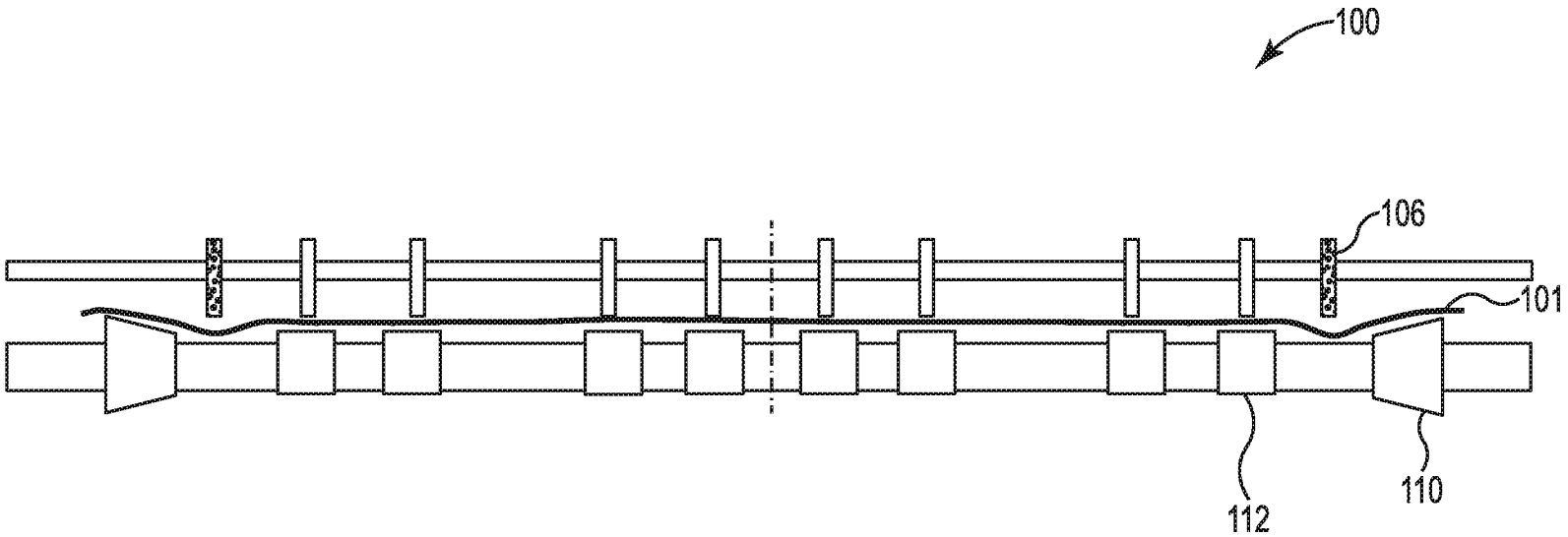
FIG. 1A illustrates an example system for output management consistent with the present disclosure.

A number of systems and devices for partially dried inkjet media output management are described herein. In some examples, a system for partially dried inkjet media output management can include a starwheel positioned on a first side between a number of rollers positioned on a second side to corrugate partially dried inkjet media between the starwheel and the number of rollers. As used herein, partially dried inkjet media can include media with applied printing fluid from an inkjet type printing device that is not completely dried on the media.

The partially dried inkjet media can provide difficulties when stacking, aligning, finishing, and/or stacking on an output tray. For example, the partially dried inkjet media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media. In some examples, the distorted properties can cause the partially dried inkjet media to scroll or curl when the partially dried inkjet media is provided to an output tray.

In some examples, the systems and methods for partially dried inkjet media output management can include corrugating the partially dried inkjet media. In some examples, the corrugation of the partially dried inkjet media can be performed by an output device between a print zone and an output tray. In some examples, it can be important for the media to be substantially smooth and flat when provided to the print zone. In these examples, the output device can corrugate the partially dried inkjet media after the printing fluid has been applied to the print media.

In some examples, the output device can corrugate the partially dried inkjet media with a starwheel positioned between a number of rollers. In some examples, the starwheel can apply pressure to the partially dried inkjet media without a roller positioned under the starwheel. For example, the starwheel can be positioned to apply pressure to a first side of the partially dried inkjet media and the number of rollers can apply pressure on a second side of the partially dried inkjet media. In this example, the starwheel positioned between the number of rollers can corrugate the partially dried inkjet media.

The systems and methods for partially dried inkjet media output management described herein can increase a stiffness of the partially dried inkjet media to prevent the partially dried inkjet media from curling or scrolling on the output tray. In some examples, the systems and methods for partially dried inkjet media output management described herein can be utilized for relatively large partially dried inkjet media (e.g., A3, etc.) where curling or scrolling can occur due to the distorted properties of the partially dried inkjet media.

FIG. 1A illustrates an example system 100 for output management consistent with the present disclosure. FIG. 1 can illustrate a front view of the system 100 for output management. In some examples, the system 100 can represent an output device that includes a starwheel 106 positioned to apply pressure to a first side of partially dried inkjet media 101. As used herein, starwheels can be a wheel shaped object with protrusion (e.g., spikes, posts that come to a point, etc.) that surround an outer edge. In some examples, the output device can include a number of rollers (e.g., shaping rollers 110, non-shaping rollers 112, etc.).

In some examples, the system 100 can include a starwheel 106 positioned between a first roller 112 and a second roller 110. For example, the starwheel 106 can be positioned at a location between a non-shaping roller 112 and a shaping roller 110 to bend or corrugate the partially dried inkjet media 101. In this example, the starwheel 106 can corrugate the partially dried inkjet media 101 as the partially dried inkjet media 101 passes between the number of rollers 112, 110 and the starwheel 106.

Figure 1B:
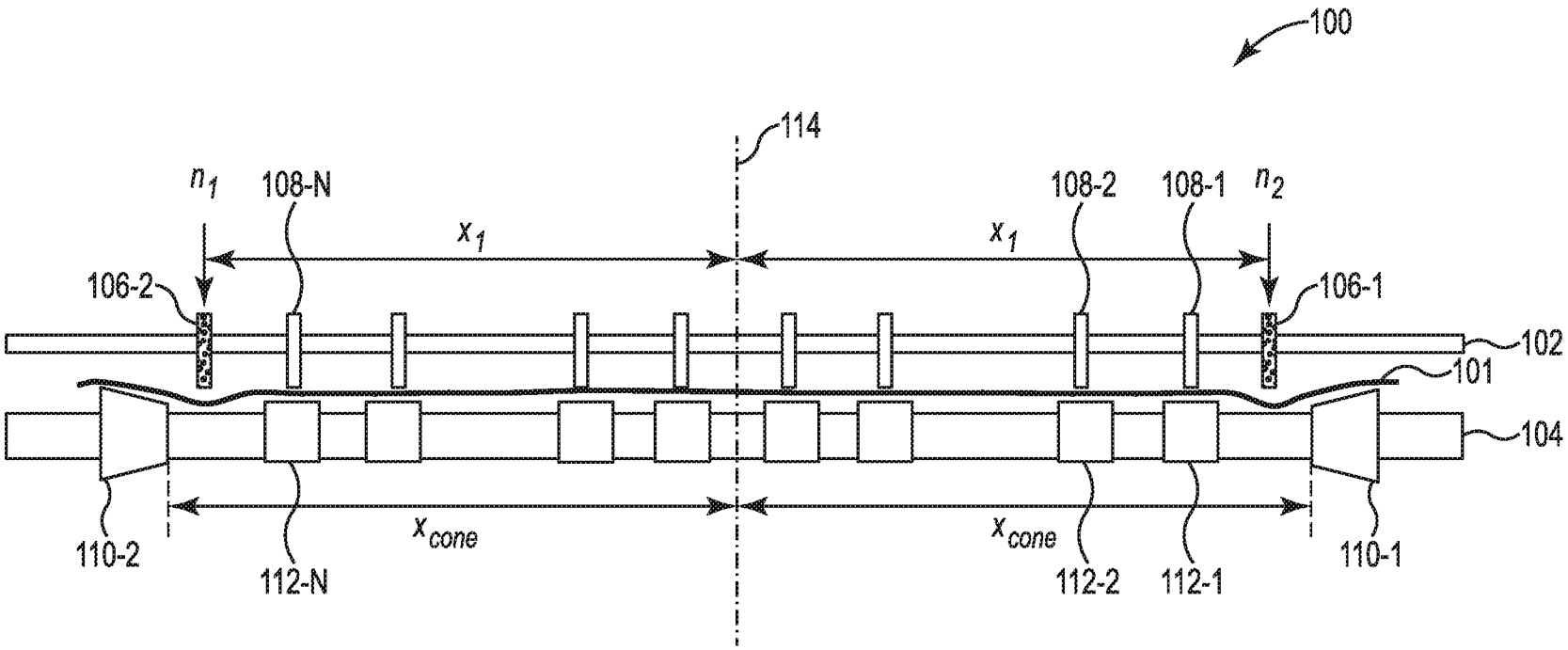
FIG. 1B illustrates an example system for partially dried inkjet media output management consistent with the present disclosure.

FIG. 1B illustrates an example system 100 for partially dried inkjet media output management consistent with the present disclosure. FIG. 1 can illustrate a front view of the system 100 for partially dried inkjet media output management. In some examples, the system 100 can represent an output device that includes a starwheel rail 102 positioned to apply pressure to a first side of partially dried inkjet media 101 with a number of starwheels (e.g., corrugation starwheel 106-1, 106-2, etc.). As used herein, starwheels can be a wheel shaped object with protrusion (e.g., spikes, posts that come to a point, etc.) that surround an outer edge. In some examples, the output device can include a cam 104 with a number of rollers (e.g., shaping rollers 110-1, 110-2, non-shaping rollers 112-1, 112-2, 112-N, etc.).

In some examples, the system 100 can include a starwheel rail 102 with a number of non-corrugation starwheels 108-1, 108-2, 108-N. In some examples, non-corrugation starwheels 108-1, 108-2, 108-N can be in line with a number of corresponding non-shaping rollers 112-1, 112-2, 112-N (e.g., tire rollers, flat rollers, etc.). In some examples, the non-corrugation starwheels 108-1, 108-2, 108-N can be positioned to apply pressure on the partially dried inkjet media 101 such that a counter pressure can be applied by the non-shaping rollers 112-1, 112-2, 112-N. For example, the non-corrugation starwheels 108-1, 108-2, 108-N can apply a pressure to a first side (e.g., top side as illustrated in FIG. 1) of the partially dried inkjet media 101 and the non-shaping rollers 112-1, 112-2, 112-N can apply a pressure to a second side (e.g., bottom side as illustrated in FIG. 1) of the partially dried inkjet media 101. In this example, the pressure applied by the non-corrugation starwheels 108-1, 108-2, 108-N and the pressure applied by the non-shaping rollers 112-1, 112-2, 112-N can be utilized to move the partially dried inkjet media 101 to an output tray.

In some examples, the system 100 can utilize a number of corrugation starwheels 106-1, 106-2 to corrugate the partially dried inkjet media 101. In some examples, the corrugation starwheels 106-1, 106-2 can be positioned between a number of rollers instead of in line with the number of rollers. For example, the corrugation starwheel 106-1 can be positioned between a non-shaping roller 112-1 and a shaping roller 110-1.

As used herein, a shaping roller 110-1, 110-2 can include a roller that has a cone shape. For example, shaping roller 110-1 can include a wider portion (e.g., base portion) towards the right side as illustrated in FIG. 1 or away from the non-shaping rollers 112-1, 112-2, 112-N. In this example, the shaping roller 110-1 can include a thinner portion (e.g., tip portion) towards the left side as illustrated in FIG. 1 or toward the non-shaping rollers 112-1, 112-2, 112-N. That is, the shaping rollers 110-1, 110-2 can be cone shaped rollers with a tip portion and a base portion. In some examples, the shaping rollers 110-1, 110-2 can be utilized to tip an edge of the partially dried inkjet media 101 towards the starwheel rail 102. For example, the shaping rollers 110-1, 110-2 can be angled to direct (e.g., tip) the partially dried inkjet media 101 upwards away from the number of non-shaping rollers 112-1, 112-2, 112-N. The tipped edges of the partially dried inkjet media 101 can stiffen the partially dried inkjet media 101 and/or prevent the partially dried inkjet media 101 from curling and scrolling on the output tray.

In some examples, the corrugation starwheels 106-1, 106-2 can apply a pressure on a first side of the partially dried inkjet media 101 and the rollers (e.g., non-shaping roller 112-1, shaping roller 110-1, etc.) can apply a pressure on either side of the corrugation starwheels 106-1, 106-2 from a second side of the partially dried inkjet media 101. In this way, the partially dried inkjet media can be corrugated by the pressure applied by the corrugation starwheels 106-1, 106-2.

In some examples, the pressure applied by the corrugation starwheels 106-1, 106-2 can be adjustable. In some examples, the pressure of the corrugation starwheels 106-1, 106-2 can be adjusted by an actuation device (e.g., actuator, etc.). In some examples, a relatively high pressure applied by the corrugation starwheels 106-1, 106-2 can apply a relatively high level of corrugation to the partially dried inkjet media 101. In some examples, a relatively low pressure applied by the corrugation starwheels 106-1, 106-2 can apply a relatively low level of corrugation to the partially dried inkjet media 101. In some examples, the level of corrugation (e.g., relatively high, relatively low, etc.) to be applied can be based on a quantity of printing fluid applied to the partially dried inkjet media 101 or predicted level of distortion of the partially dried inkjet media 101. For example, a greater level of corrugation can be applied to the partially dried inkjet media 101 when a relatively large quantity of printing fluid is applied to the partially dried inkjet media 101. In some examples, the level of corrugation applied to the partially dried inkjet media 101 can be based on a size of the partially dried inkjet media 101. For example, a greater level of corrugation can be applied to partially dried inkjet media 101 that has a relatively large size, since the distorted properties caused by the printing fluid can increase scrolling of relatively larger sized print media (e.g., size A3, etc.).

In some examples, the system 100 can include a center point 114. In some examples, the center point 114 can divide the starwheel rail 102 and cam 104 into two equal parts. In some examples, the distance from the center point 114 to each of the corrugation starwheels 106-1, 106-2 can be represented by a distance $X_1$. In some examples, the distance $X_1$ can be approximately 117.96 mm. In some examples, the distance from the center point 114 to each of the shaping rollers 110-1, 110-2 can be represented by a distance $X_{con}$. In some examples, the distance $X_{con}$ can be approximately 134.86 mm. In some examples, the distance $X_1$ and the distance $X_{con}$ can be utilized for print media with a size of A3. The distances described herein can be adjusted for different applications and/or devices.

Figure 2:
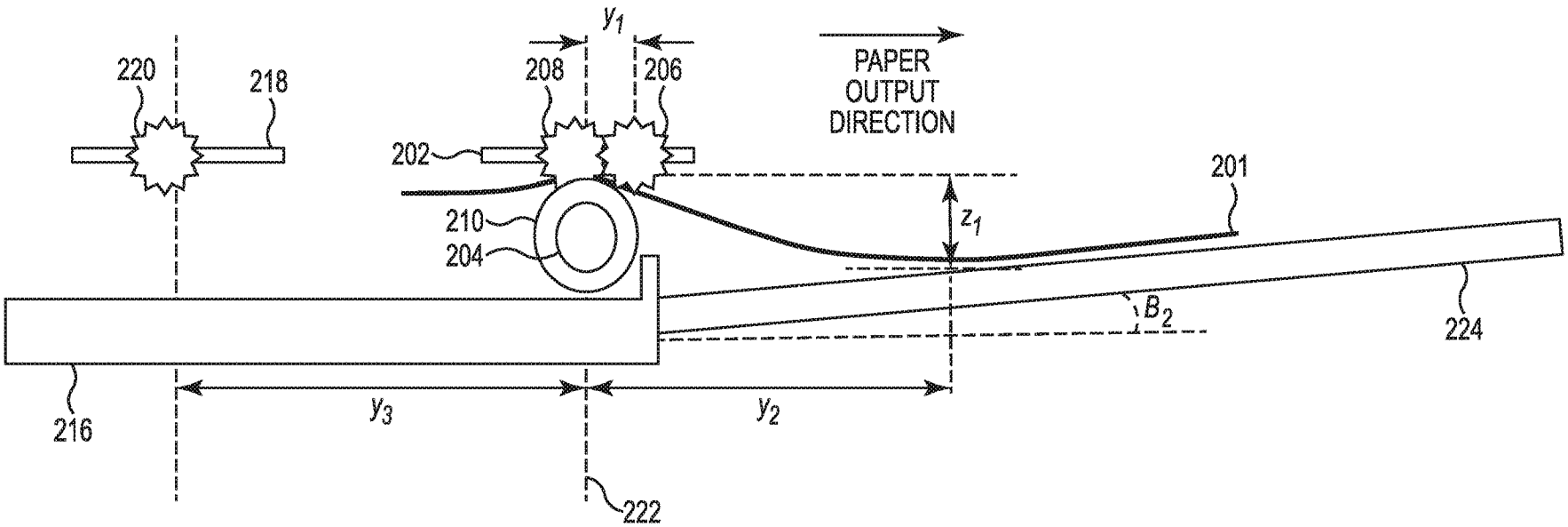
FIG. 2 illustrates an example system for partially dried inkjet media output management consistent with the present disclosure.

FIG. 2 illustrates an example system 200 for partially dried inkjet media output management consistent with the present disclosure. FIG. 2 can illustrate a side view of the system 200 for partially dried inkjet media output management. In some examples, the system 200 can include the same or similar features as system 100 as referenced in FIG. 1. For example, the system 200 can include starwheel rail 202 with a number of non-corrugation starwheels 208 and a number of corrugation starwheels 206. In addition, the system 200 can include a cam 204 with a number of shaping rollers 210 and a number of non-shaping rollers (not shown).

As described herein, the number of non-corrugation starwheels 208 can be positioned in line with the number of non-shaping rollers. In some examples, the non-corrugation starwheels 208 can be positioned to tip the partially dried inkjet media 201 toward the starwheel rail 202 and away from the output tray 224. In some examples, a center of the non-corrugation starwheel 208 can be positioned to the left of a center of the cam 204 as illustrated in FIG. 2. In some examples, the center of the non-corrugation starwheel 208 can be positioned on a first side of the cam 204. In some examples, the first side of the cam 204 can be towards a print area.

As described herein, the number of corrugation starwheels 206 can be positioned between one of the number of non-shaping rollers and the shaping roller 210. In some examples, the corrugation starwheels 206 can be positioned to tip the partially dried inkjet media 201 toward the cam 204 and toward the output tray 224. In some examples, the corrugation starwheels 206 can be positioned to tip the partially dried inkjet media 201 in an opposite direction compared to the non-corrugation starwheel 208. For example, the non-corrugation starwheel 208 can tip the partially dried inkjet media 201 in a downward direction as illustrated in FIG. 2 and the corrugation starwheel 206 can tip the partially dried inkjet media 201 in an upward direction as illustrated in FIG. 2.

In some examples, a center of the corrugation starwheel 206 can be positioned on a second side of the cam. In some examples, the second side of the cam can be towards the output tray 224. In some examples, the center of the corrugation starwheel 206 can be positioned to the right of the cam 204 a distance $Y_1$ as illustrated in FIG. 2. In some examples, the distance $Y_1$ can be 5 millimeters (mm). In some examples, a number of additional starwheel rails 218 with corresponding non-corrugation starwheels 220 can be positioned between the starwheel rail 202 and the print area. In some examples, the additional starwheel rails 218 may not include corrugation starwheels as described herein. In some examples, the additional starwheel rail 218 can be positioned a distance $Y_3$ from a center 222 of the cam 204. In some examples, the distance $Y_3$ can be approximately 75 mm.

In some examples, the system 200 can include a base 216. The base 216 can be utilized to mount a number of elements within the system 200. For example, the base 216 can be utilized to mount the output tray 224 to the system 200. In some examples, the output tray 224 can be positioned at an angle $B_2$ from the base 218. In some examples, the angle $B_2$ can be based on a level of corrugation generated by the corrugation starwheel 206 as described herein. In some examples, the output tray 224 can be positioned at an angle $B_2$ of 10 degrees towards a direction from a position below the cam (e.g., base 216, etc.). In some examples, the level of corrugation and/or the quantity of printing fluid applied to the partially dried inkjet media 201 can affect a distance $Y_2$. In some examples, the distance $Y_2$ can be a minimum distance partially dried inkjet media 201 can travel to prevent curling or scrolling of the partially dried inkjet media 201. For example, the distance $Y_2$ can be a distance such that relatively large print media can be provided to the output tray 224 without curling or scrolling on the output tray 224.

In some examples, the distance $Y_2$ can be based on a height $Z_1$ between a position where the partially dried inkjet media 201 will land on the output tray and the point where the non-corrugation starwheel 208 meets a non-shaping roller. In some examples, the height $Z_1$ can be 13.96 mm. In some examples, the distance $Y_2$ can be based on a level of corrugation and/or a quantity of print media on the output tray 224. In some examples, the height $Z_1$ and/or angle $B_2$ can be altered to adjust the impact point of the partially dried inkjet media 201. In some examples, the height $Z_1$ and/or angle $B_2$ can be adjusted utilizing a number of actuators coupled to the output tray 224.

Figure 3:
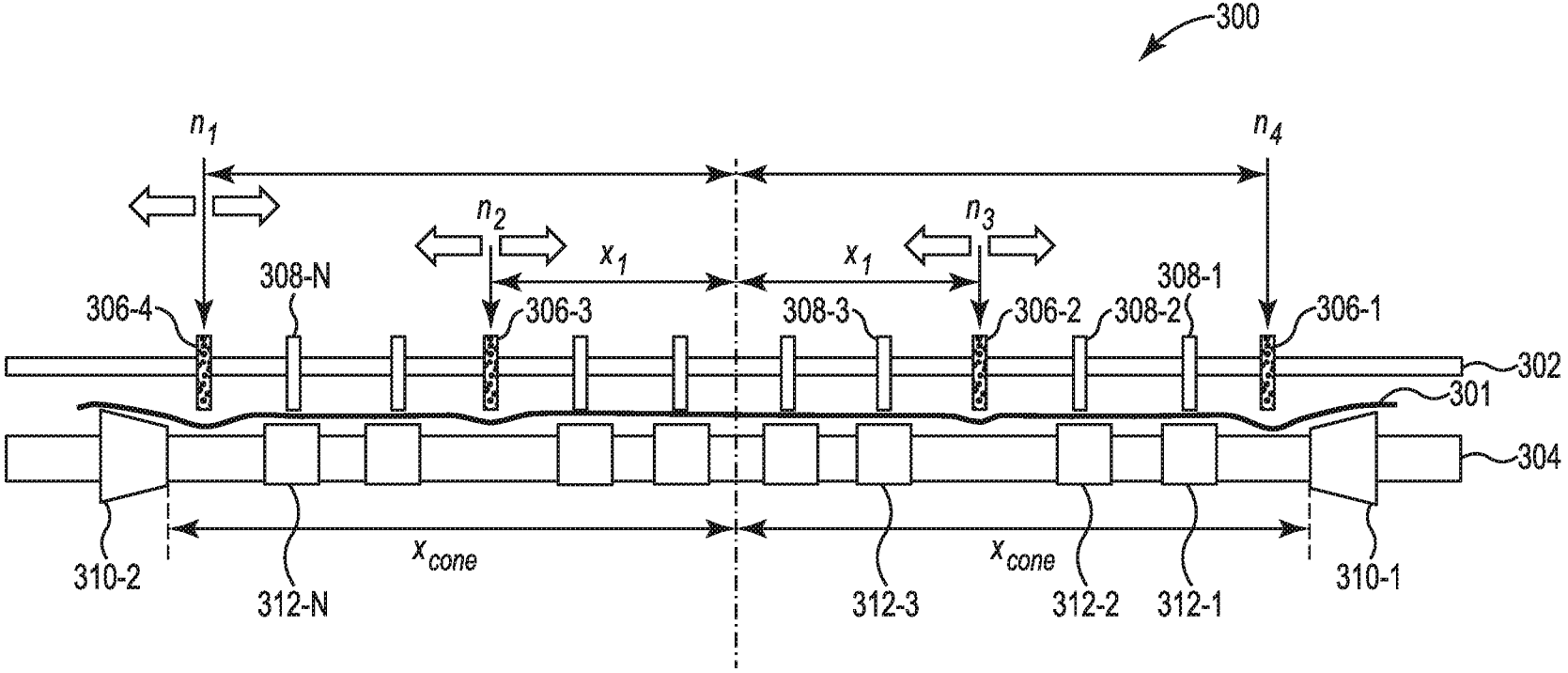
FIG. 3 illustrates an example system for partially dried inkjet media output management consistent with the present disclosure.

FIG. 3 illustrates an example system 300 for partially dried inkjet media output management consistent with the present disclosure. FIG. 3 can illustrate a front view of the system 300 for partially dried inkjet media output management. In some examples, the system 300 can include the same or similar features as system 100 as referenced in FIG. 1. For example, the system 300 can include a starwheel rail 302 positioned on a first side of partially dried inkjet media 301 and a cam 304 with a number of rollers on a second side of the partially dried inkjet media 301.

As described herein, the system 300 can include a cam 304 with a number of non-shaping rollers 312-1, 312-2, 312-3, 312-N and a number of shaping rollers 310-1, 310-2 coupled to the cam 304. In addition, the starwheel rail 302 can include a number of corrugation starwheels 306-1, 306-N that are positioned between one of the non-shaping rollers (e.g., non-shaping roller 312-1, non-shaping roller 312-N) and one of the shaping rollers (e.g., shaping roller 310-1, shaping roller 310-2). For example, corrugation starwheel 306-1 can be positioned between shaping roller 310-1 and non-shaping roller 312-1.

In some examples, the system 300 can include a corrugation starwheel 306-2, 306-3 positioned between a number of non-shaping rollers 312-1, 312-2, 312-3, 312-N. For example, a corrugation starwheel 306-2 can be positioned between non-shaping roller 312-2 and non-shaping roller 312-3. In some examples, the system 300 can generate a plurality of corrugation areas on the partially dried inkjet media 301 corresponding to the corrugation starwheels 306-1, 306-2, 306-3, 306-4. As described herein, each of the corrugation starwheels 306-1, 306-2, 306-3, 306-4 can be adjustable to apply a particular level of pressure to the partially dried inkjet media 301. As described herein, the level of pressure applied to the partially dried inkjet media 301 can correspond to a level of corrugation for the partially dried inkjet media 301.

Figure 4:
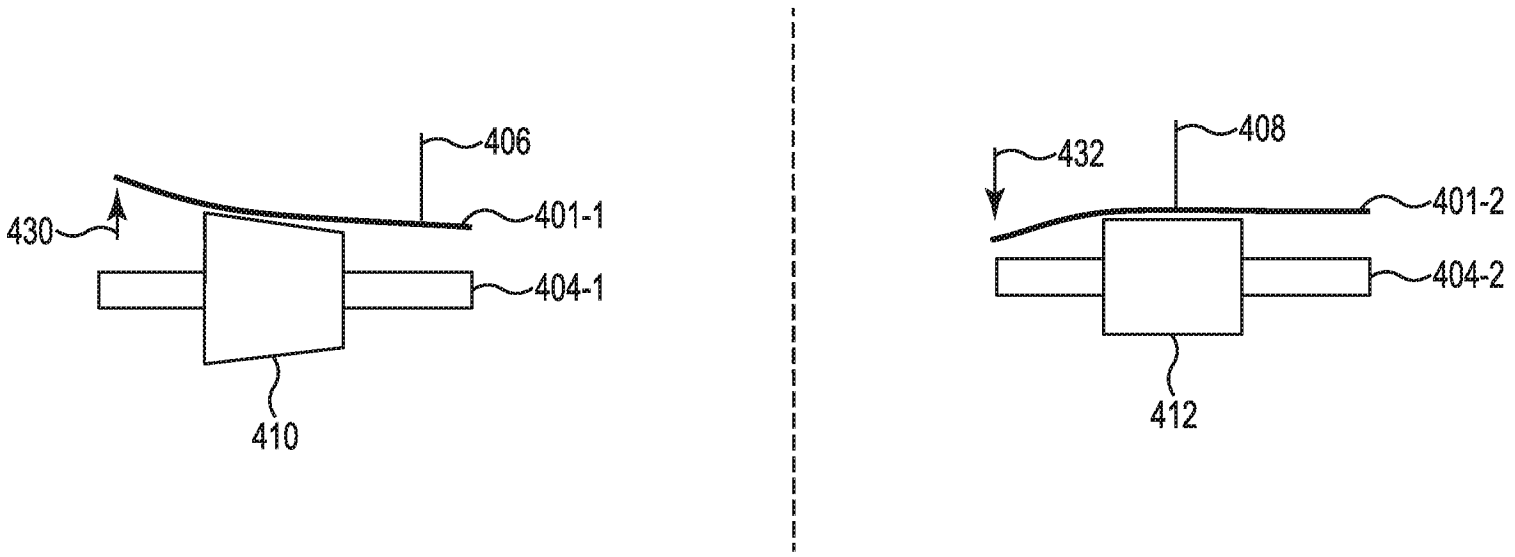
FIG. 4 illustrates an example rollers for partially dried inkjet media output management consistent with the present disclosure.

FIG. 4 illustrates an example rollers 410, 412 for partially dried inkjet media output management consistent with the present disclosure. In some examples, the rollers 410, 412 can correspond to rollers 310, 312 as referenced in FIG. 3, rollers 210, 212 as referenced in FIG. 2, and rollers 110, 112 as referenced in FIG. 1, FIG. 4 can illustrate the rollers 410, 412 from a front view.

In some examples, the shaping roller 410 can be a cone shaped polymer roller. In some examples, the shaping roller 410 can be coupled to a cam 404-1. As described herein, a corrugation starwheel 406 can be positioned on a first side of the partially dried inkjet media 401-1 and the shaping roller 410 can be positioned on a second side of the partially dried inkjet media 401-1. In some examples, the pressure applied by the corrugation starwheel 406 can generate a corrugation of the partially dried inkjet media 401-1. In some examples, the cone shape of the shaping roller 410 can direct an edge of the partially dried inkjet media 401-1 in a direction 430 that is away from the cam 404-1. Directing the edge of the partially dried inkjet media 401-1 in the direction 430 can prevent the partially dried inkjet media from curling or scrolling as described herein. In some examples, directing the edge of the partially dried inkjet media 401-1 in the direction 430 can prevent the edge from decreasing friction between the partially dried inkjet media 401-1 and the output tray. In some examples, the output tray can include curved surfaces positioned to receive the partially dried inkjet media 401-1 with the edge of the partially dried inkjet media 401-1 directed in the direction 430 by the shaping roller 410.

In contrast a non-shaping roller 412 coupled to a cam 404-2 with a starwheel 408 positioned in line with the non-shaping roller 412 can cause a droop or drop of the partially dried inkjet media 401-2 in the direction 432. This droop or drop in the partially dried inkjet media 401-2 can increase a friction between the partially dried inkjet media 401-2 and the output tray, which can cause an increase of curling or scrolling across the output tray. In some examples, the output tray can include curved surfaces positioned to receive the partially dried inkjet media with the edge of the partially dried inkjet media 401-2 directed in the direction 432 by the non-shaping roller 412. In this example, the curved surfaces on the sides of the output tray can be utilized to direct the partially dried inkjet media 41-2 in the direction 430 and thus lower the friction caused by the direction 432 of the partially dried inkjet media 401-2.

Figure 5:
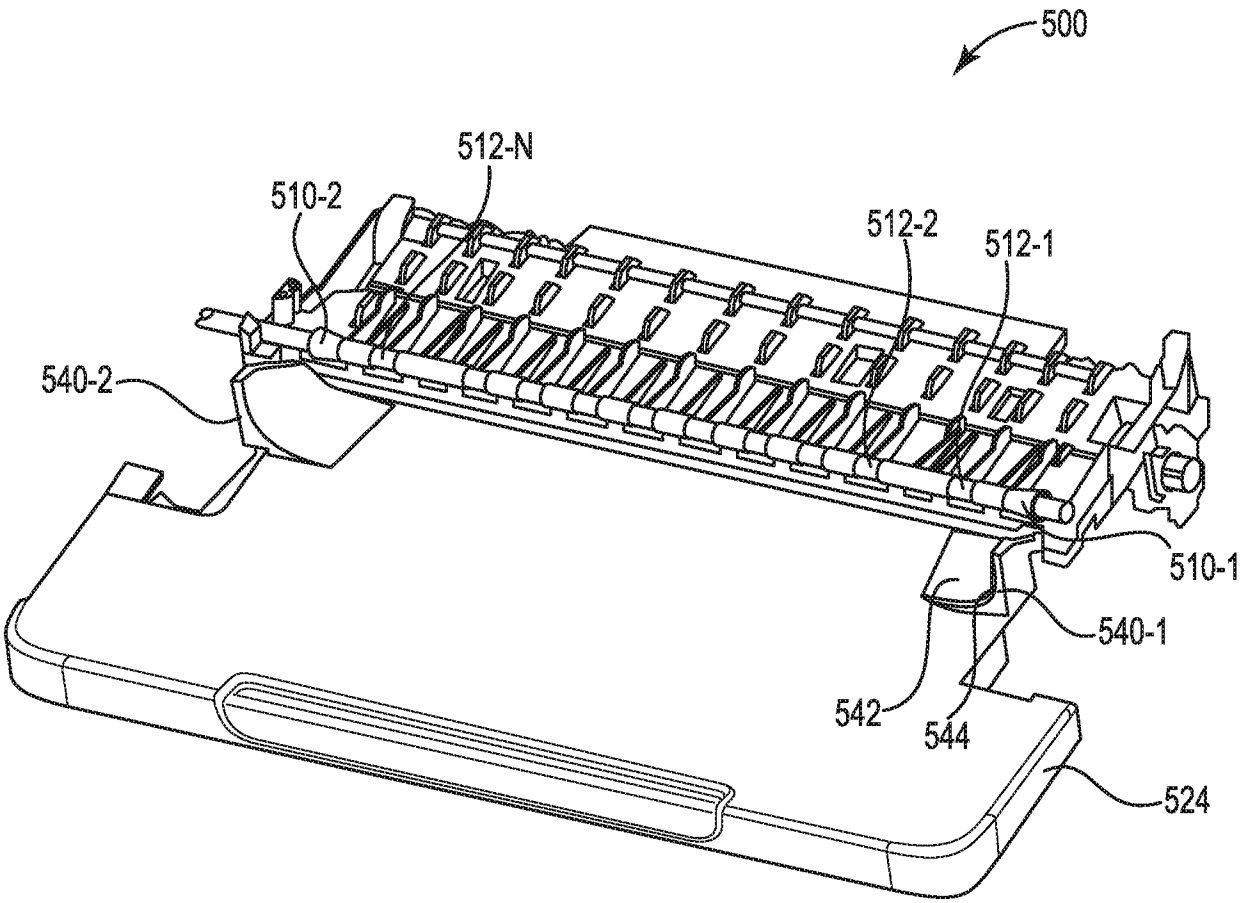
FIG. 5 illustrates an example system for partially dried inkjet media output management consistent with the present disclosure.

FIG. 5 illustrates an example system 500 for partially dried inkjet media output management consistent with the present disclosure. In some examples, the system 500 can utilize the same or similar features as system 100 as referenced in FIG. 1, system 200 as referenced in FIG. 2, and/or system 300 as referenced in FIG. 3. For example, the system 500 can include a number of shaping rollers 510-1, 510-2 and a number of non-shaping rollers 512-1, 512-2, 512-N. In some examples, the system can include an output tray 524 with a number of curved surfaces 540-1, 540-2.

As described herein, the number of shaping rollers 510-1, 510-2 can be utilized to direct partially dried inkjet media in a direction away from the output tray 524. For example, the output tray 524 can be positioned below the number of shaping rollers 510-1, 510-2. In this example, the number of shaping rollers 510-1, 510-2 can direct edges of the partially dried inkjet media in an upward direction away from the output tray 524. In some examples, the number of curved surfaces 540-1, 540-2 can be positioned to receive the edges of the partially dried inkjet media to reduce friction between the partially dried inkjet media and the output tray 524. As described herein, lowering the friction between the partially dried inkjet media and the output tray 524 can reduce curling or scrolling of the partially dried inkjet media.

In some examples, the curved surfaces 540-1, 540-2 can a first portion 542 and a second portion 544. In some examples, the first portion 542 can be coupled to the output tray 524. In some examples, the first portion 542 can be positioned at the same or similar level as the output tray 542. For example, the first portion 542 can be level with the rest of the output tray 542. In some examples, the second portion 544 can be curved away from the output tray 542. For examples, the second portion 544 can be curved in an upward direction similar to the direction that the shaping rollers 510-1, 510-2 direct the partially dried inkjet media.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A device for output management, comprising:

a starwheel positioned on a first side between a shaping roller and a non-shaping roller positioned on a second side to corrugate partially dried inkjet media between the starwheel and the number of rollers, wherein the shaping roller and the non-shaping roller are coupled to a cam on the second side.

2. The device of claim 1, wherein the starwheel is coupled to an actuation device that adjusts a pressure applied to the partially dried inkjet media by the starwheel.

3. The device of claim 1, wherein the starwheel is positioned to tip the partially dried inkjet media towards the second side.

4. The device of claim 1, wherein a corresponding starwheel is coupled to the cam to tip the partially dried inkjet media towards the first side.

5. A system for partially dried inkjet media output management, comprising:

a cam comprising a shaping roller and a non-shaping roller positioned to receive partially dried inkjet media from a first side;

a starwheel positioned between the shaping roller and the non-shaping roller to corrugate the partially dried inkjet media, wherein the starwheel is positioned to apply pressure to the partially dried inkjet media from a second side.

6. The system of claim 5, wherein the shaping roller is positioned to tip the partially dried inkjet media towards the second side.

7. The system of claim 5, wherein the shaping roller is a cone-shaped roller.

8. The system of claim 5, wherein the cam is positioned between a print area and an output tray of an inkjet printer to receive partially dried inkjet media from the print area and deliver the partially dried inkjet media to the output tray.

9. The system of claim 8, wherein a portion, of the starwheel is positioned between the cam and an output tray to tip the partially dried inkjet media towards the first side.

10. The system of claim 8, wherein the output tray is positioned at an angle of 10 degrees towards the second direction from a position below the cam.

11. A system for partially dried inkjet media output management, comprising:

a corrugator positioned between a print area and an output tray of a printing device; and the corrugator comprising:

a cam comprising a first shaping roller and a plurality of non-shaping rollers between the first shaping roller and a second shaping roller;

a first corrugating starwheel between the first shaping roller and the plurality of non-shaping rollers;

a second corrugating starwheel between the plurality of non-shaping rollers and the second shaping roller; and a non-corrugating starwheel positioned on each of the non-shaping rollers.

12. The system of claim 11, wherein the first corrugating starwheel and the second corrugating starwheel are positioned to tip partially dried inkjet media toward a side of the output tray.

13. The system of claim 12, wherein the non-corrugating starwheel is positioned to tip the partially dried inkjet media away from a side of the output tray.

14. The system of claim 11, wherein the first corrugating starwheel and the second corrugating starwheel are adjustable to apply a number of different pressures on the partially dried inkjet media.

* * * * *